US008381332B2

(12) United States Patent
Fakhrizadeh

(10) Patent No.: US 8,381,332 B2
(45) Date of Patent: Feb. 26, 2013

(54) SLING SYSTEM

(76) Inventor: Mohammad Fakhrizadeh, Nashua, NH (US)

( * ) Notice: Subject to any disclaimer, the term of this patent is extended or adjusted under 35 U.S.C. 154(b) by 0 days.

(21) Appl. No.: 12/963,741

(22) Filed: Dec. 9, 2010

(65) Prior Publication Data

US 2011/0277237 A1 Nov. 17, 2011

Related U.S. Application Data

(60) Provisional application No. 61/334,639, filed on May 14, 2010.

(51) Int. Cl.
*A61G 7/12* (2006.01)

(52) U.S. Cl. ..... 5/89.1; 5/87.1; 5/85.1

(58) Field of Classification Search ..... 5/81.1 R, 5/83.1, 85.1, 87.1, 89.1
See application file for complete search history.

(56) References Cited

U.S. PATENT DOCUMENTS

| | | | | |
|---|---|---|---|---|
| 3,996,632 | A * | 12/1976 | Bakker nee Viel | 5/83.1 |
| 4,138,750 | A * | 2/1979 | Michalowski | 5/89.1 |
| 4,221,011 | A * | 9/1980 | Flinchbaugh | 5/89.1 |
| 5,499,408 | A * | 3/1996 | Nix | 5/85.1 |
| 6,105,184 | A * | 8/2000 | Onishi | 5/89.1 |
| 7,634,824 | B2 * | 12/2009 | Gramkow et al. | 5/81.1 R |

* cited by examiner

*Primary Examiner* — Michael Trettel
(74) *Attorney, Agent, or Firm* — Kristina M. Grasso, Esq. PLLC

(57) ABSTRACT

A rigid sling system is provided to ease the lifting of a disabled person by sliding its constituent sections under the subject as opposed to lifting the disabled person into the sling. This sling system is comprised of two sections, a right section and a left section. A right side main frame and its appropriate straps, a back connector, a right leg support, and a front connector with its appropriate straps are constituent members of the right section of the sling system. A left main frame and its appropriate straps, a left leg support are constituent members of the left section of the sling system. The two sections interlock via the connectors and configure to become engaged to a person lifting the sling system.

13 Claims, 8 Drawing Sheets

142
132
146
140
145
131

140
144
146
142

143
140
145
138
132
131
134
136

158
30
38
150
43
42
154
156

SLING SYSTEM

RELATED APPLICATIONS

This application claims the benefit of U.S. provisional patent application No. 61/334,639 filed May 5, 2010, which is herein incorporated in its entirety by reference.

TECHNICAL FIELD

The invention relates to slings used with lifters to mobilize a disabled person. More particularly, the invention relates to a rigid sling system whose constituent sections may be slid under the individual and interlocked while the person is in a sitting position, e.g. in a wheelchair, embracing, as opposed to lifting, the individual into a sling and ready to become engaged to any lifting device via adjustable straps.

BACKGROUND

Due to the lack of mobility, a handicapped person is dependent on others. In addition to creating difficulties in completing daily tasks, this dependency also creates hardships for those around them. The lack of mobility and the feeling of burdening others have long term physical and mental effects on both the handicapped person and those around them.

Regardless of the means (e.g. lifter), a type of sling is used to move a disabled person from one point to another. At present, a variety of slings have been designed and are being employed. Existing slings are either too bulky or there is a need to position the disabled person into them, which requires some manual lifting of the subject, or they are made of a type of fabric or strap supports which makes these slings flexible. The flexibility of these slings combined with the compressibility of the disabled person's body requires a long vertical range of movement for the lifting devices to do the actual lifting, resulting in limitations in the usefulness of these types of slings. These slings also exert lateral pressure on the individual's body causing discomfort and possibly affecting circulation in the contact area.

What is needed, therefore, are means to eliminate the disadvantages of the existing slings for lifting a disabled person. The use of a rigid sling system that can be slid comfortably and safely under the disabled person with minimal effort from a lay person and secures the subject without inserting lateral pressure while requiring minimal lifting of the subject is highly desirable. Hence this invention provides a practical solution.

SUMMARY

One embodiment of the invention provides a durable, rigid, lightweight sling system with its constituent sections easily able to slide under a disabled person, then interlock and support the person. All the constituent pieces that come in contact with the person's body are coated with hypoallergenic material. In addition, it is designed to be used for toilet and bathing purposes.

Another embodiment of the invention provides a rigid sling system with a lifting device to use minimal vertical movement to separate the person from the place they are sitting. It also eliminates the lateral forces on the user, thus making the whole process easier and more comfortable.

In another embodiment, the use of such a sling system does not require another individual to lift the disabled person into the sling. Rather, the assistant may place this sling system easily and safely under the subject while the subject is sitting in a wheelchair, car, couch, bed, or office chair. This may be accomplished by simply pushing the disabled person to one side, which will position the buttocks and thigh so the proper section of the sling may be slid under the proper area. This process will be repeated for the opposite side. After both sections are in position and assembled, the sling is ready for use. Note that this assisting person could be almost anyone, man, woman, or young adult.

In another embodiment, when the sling system is used to transfer a disabled person to a car or any other place and one wishes to remove it from under the person, just undo the locking system to detach the left and the right sections of the sling and slide out the constituent sections safely and easily, confident that it can be readily used as needed.

In another embodiment, no tools are required for assembling or disassembling of the sling system. When the sling system sections are detached, it may be transported or stored anywhere without occupying much space.

The features and advantages described herein are not all-inclusive and, in particular, many additional features and advantages will be apparent to one of ordinary skill in view of the drawings, photos, specification, and claims. Moreover, it should be noted that the language used in the specification has been principally selected for instructional purposes, and not to limit the scope of the inventive subject matter.

BRIEF DESCRIPTION OF THE DRAWINGS AND PHOTOS

DETAILED DESCRIPTION

Figure 1:
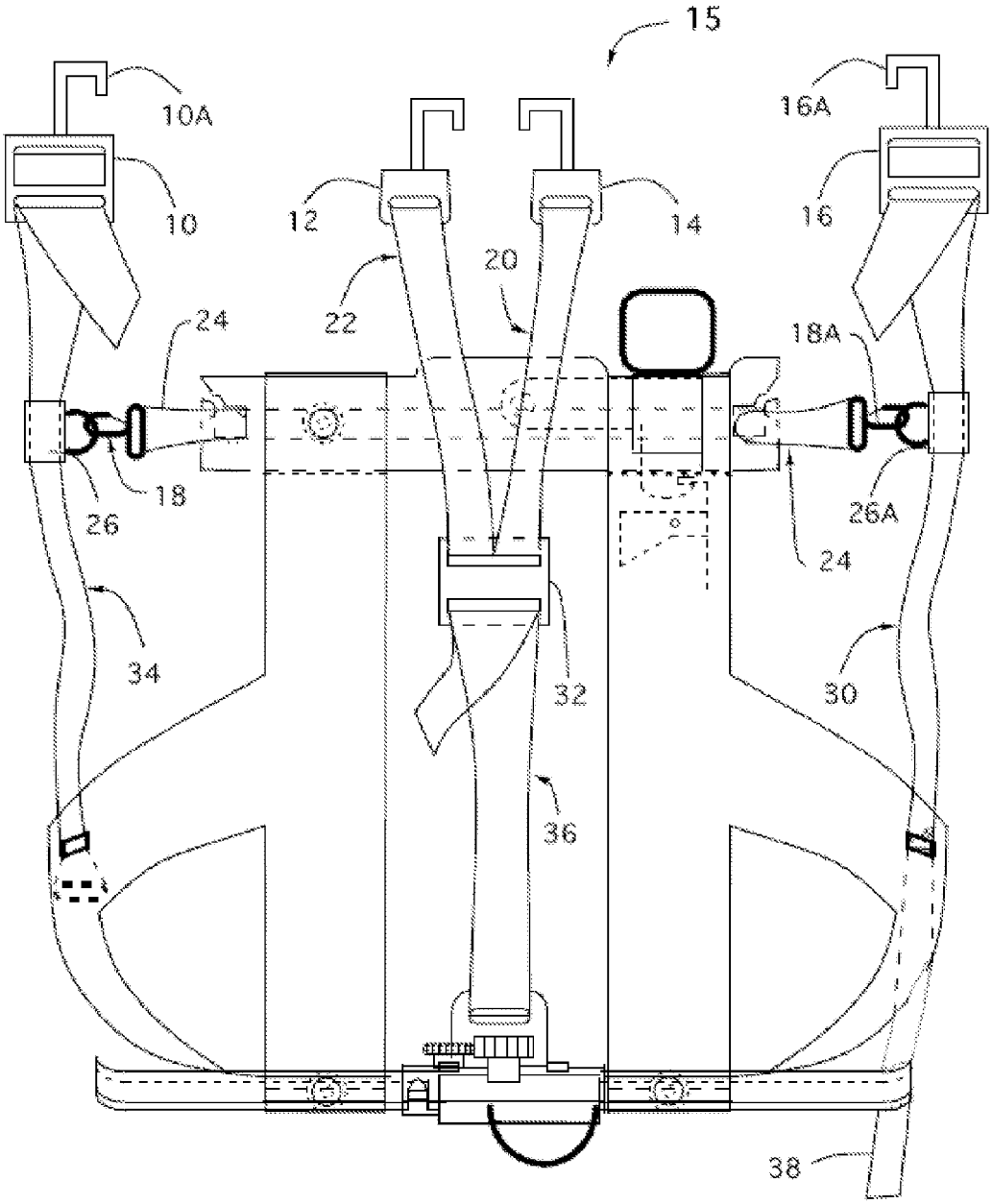
FIG. 1 is a block diagram illustrating a front view of the two piece sling system, ready to be attached to a lifting device configured in accordance with one embodiment.
Figure 2B:
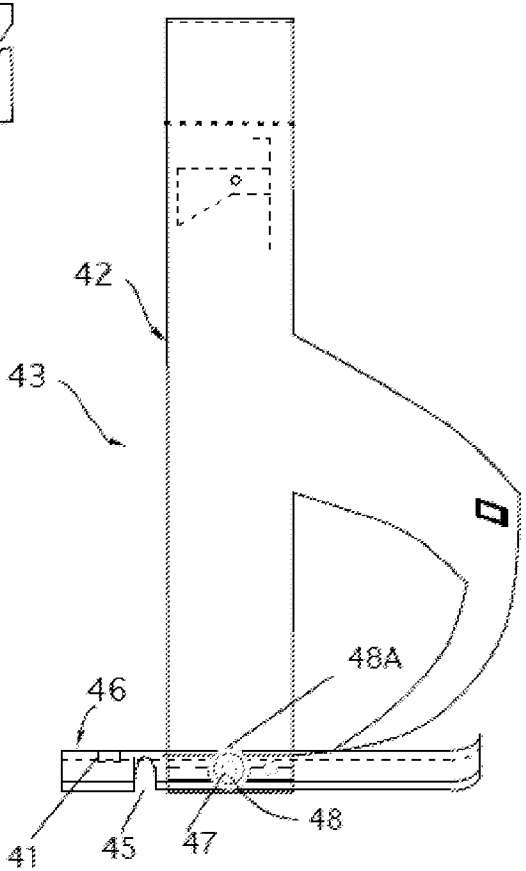
FIG. 2B is a block diagram illustrating a front view of a left section of the sling system configured in accordance with one embodiment.
Figure 3B:
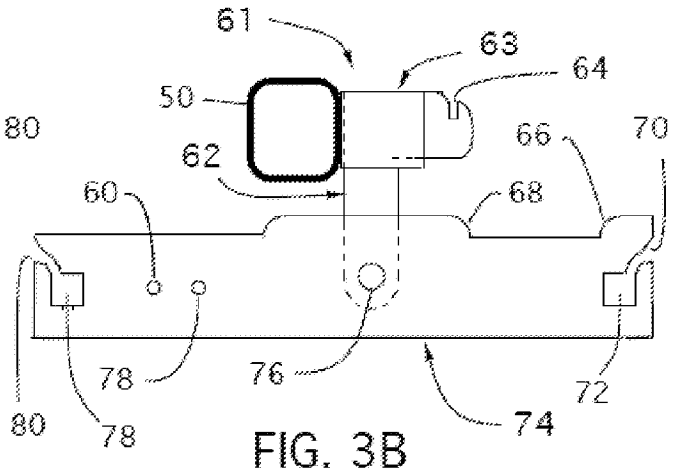
FIG. 3B is a block diagram illustrating a front view of a back side connector configured in accordance with one embodiment.
Figure 4C:
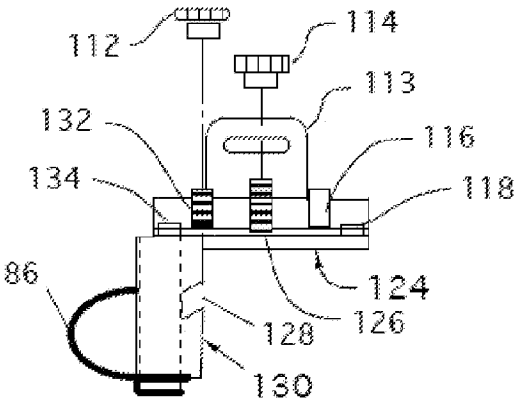
FIG. 4C is a block diagram illustrating a front view of a front side connector configured in accordance with one embodiment.
Figure 4B:
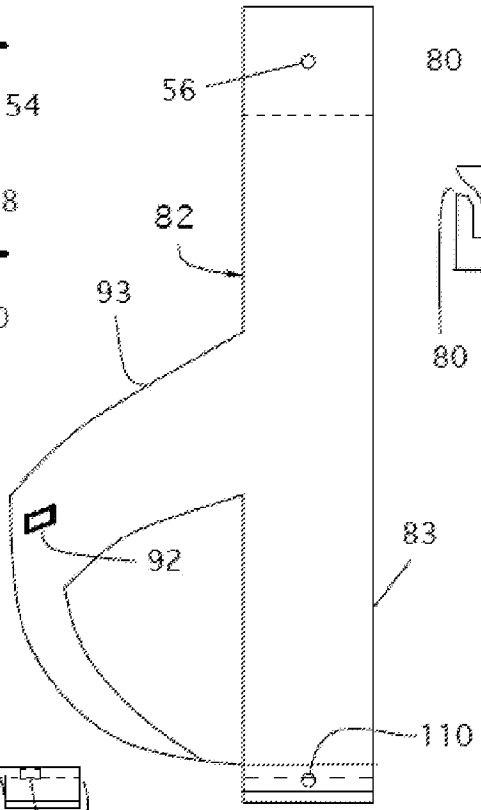
FIG. 4B is a block diagram illustrating a front view of a right side main frame configured in accordance with one embodiment.
Figure 4A:
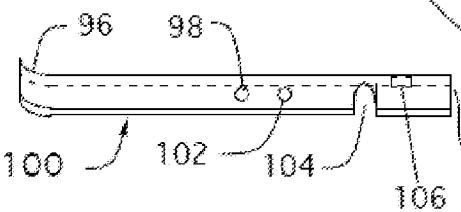
FIG. 4A is a block diagram illustrating a front view of a right leg support member configured in accordance with one embodiment.
Figure 7:
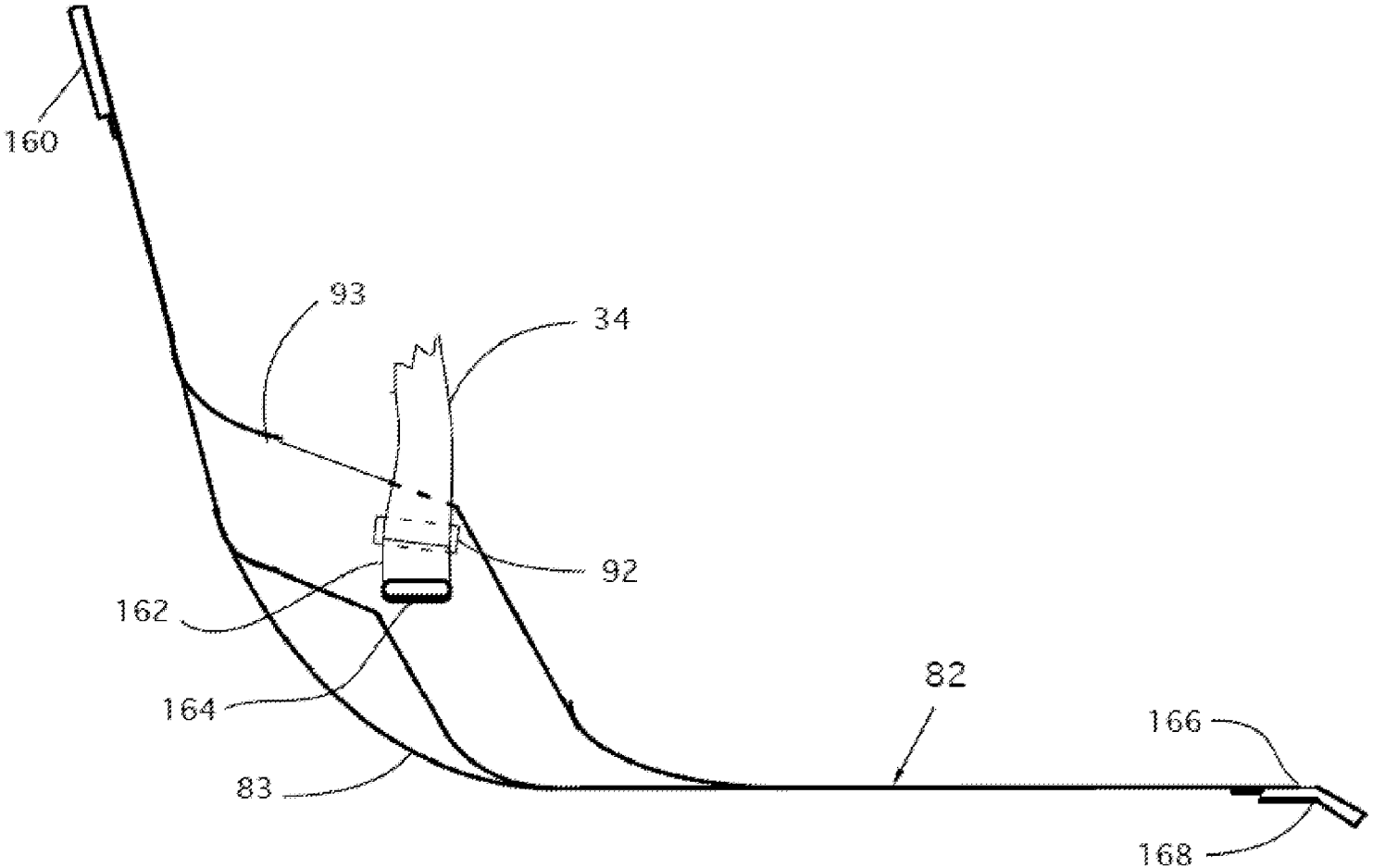
FIG. 7 is a block diagram illustrating a side view of a right side main frame configured in accordance with one embodiment.
Figure 8:
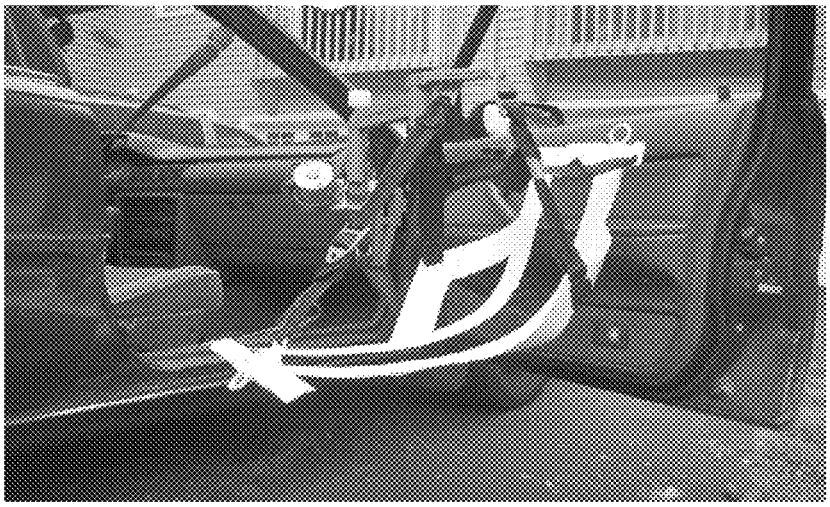
FIG. 8 is a photograph of one embodiment of the sling system being interlocked and connected to a lifter.
Figure 9:
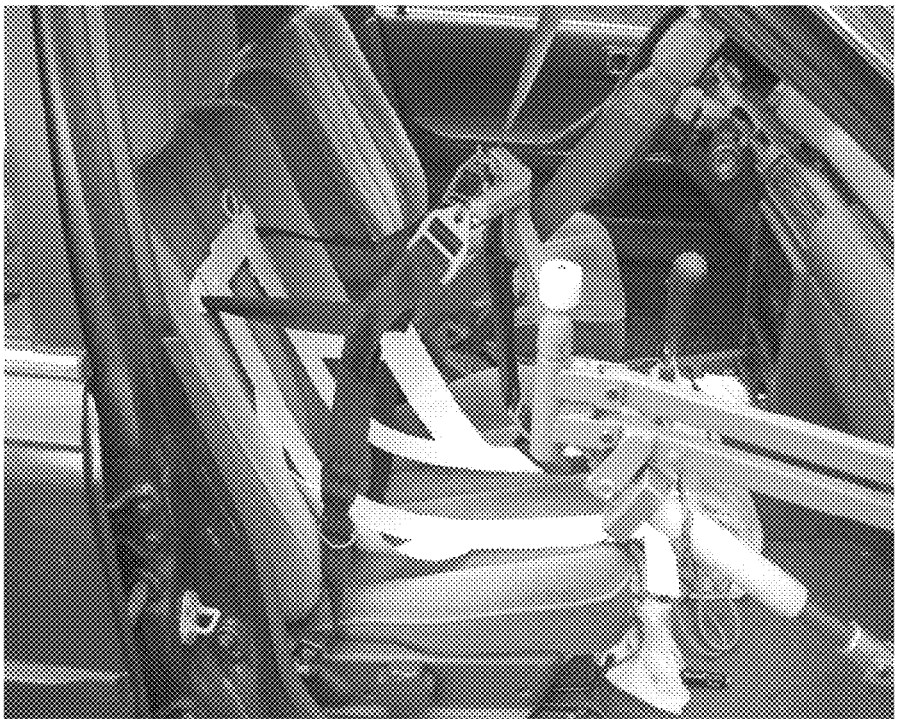
FIG. 9 is a photograph of the sling system which has been swung to a position inside a vehicle configured in accordance with one embodiment.
Figure 10:
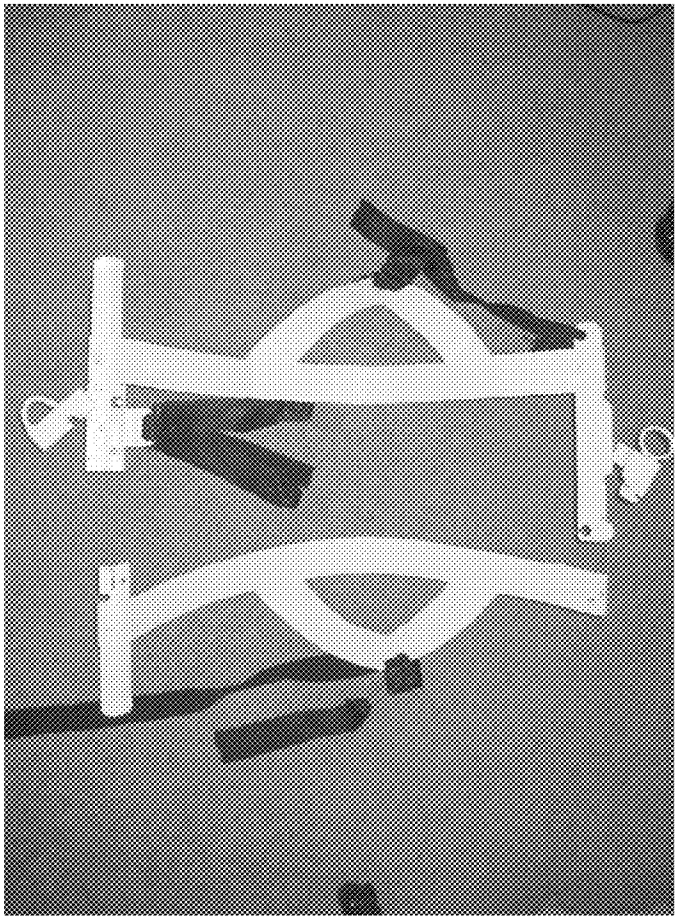
FIG. 10 is a photograph of the right section FIG. 2A and the left section FIG. 2B of the sling system configured in accordance with one embodiment.
Figure 11:
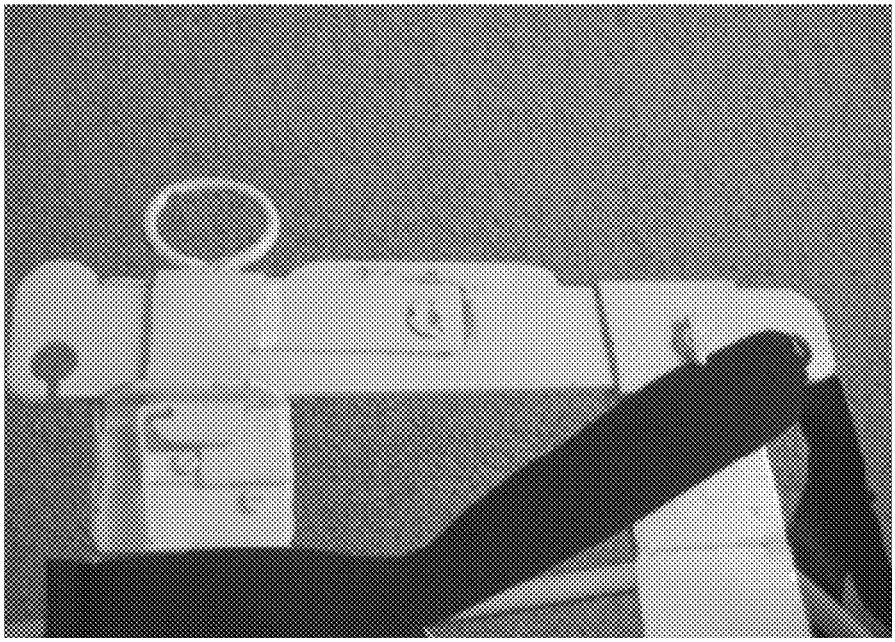
FIG. 11 is a photograph of a back side connector FIG. 3B, connecting a left side main frame of FIG. 2B and a right side main frame of FIG. 4B via a back connector receiver of FIG. 5C configured in accordance with one embodiment.
Figure 12:
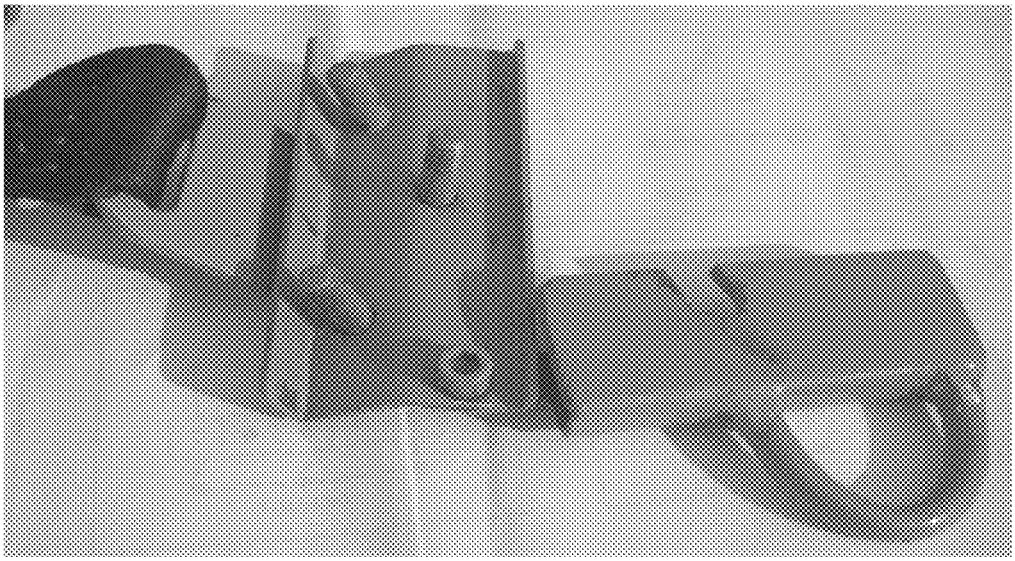
FIG. 12 is a photograph of a front side connector FIG. 4C configured in accordance with one embodiment.
Figure 13:
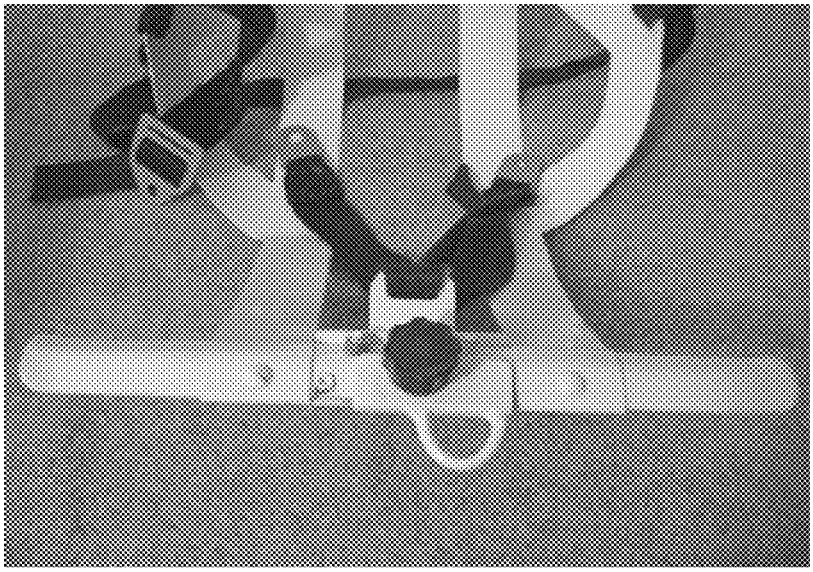
FIG. 13 is a photograph of a front side connector FIG. 4C connecting a right leg support member of FIG. 4A and a left leg support member of FIG. 2B configured in accordance with one embodiment.

One embodiment of the present invention provides a durable, rigid sling system comprised of a right side main frame 82 of FIG. 4B, a left side main frame 42 of FIG. 2B, a back side connector FIG. 3B, a front side connector FIG. 4C, a right leg support FIG. 4A, a left leg support 46 of FIG. 2B, and straps 20, 22, 24, 30, 34, 36, 38 of FIG. 1, strap 162 of FIG. 7 and their appropriate buckles and hooks. All parts are configured to be assembled or disassembled without tools in accordance with another embodiment of this invention.

Figure 2A:
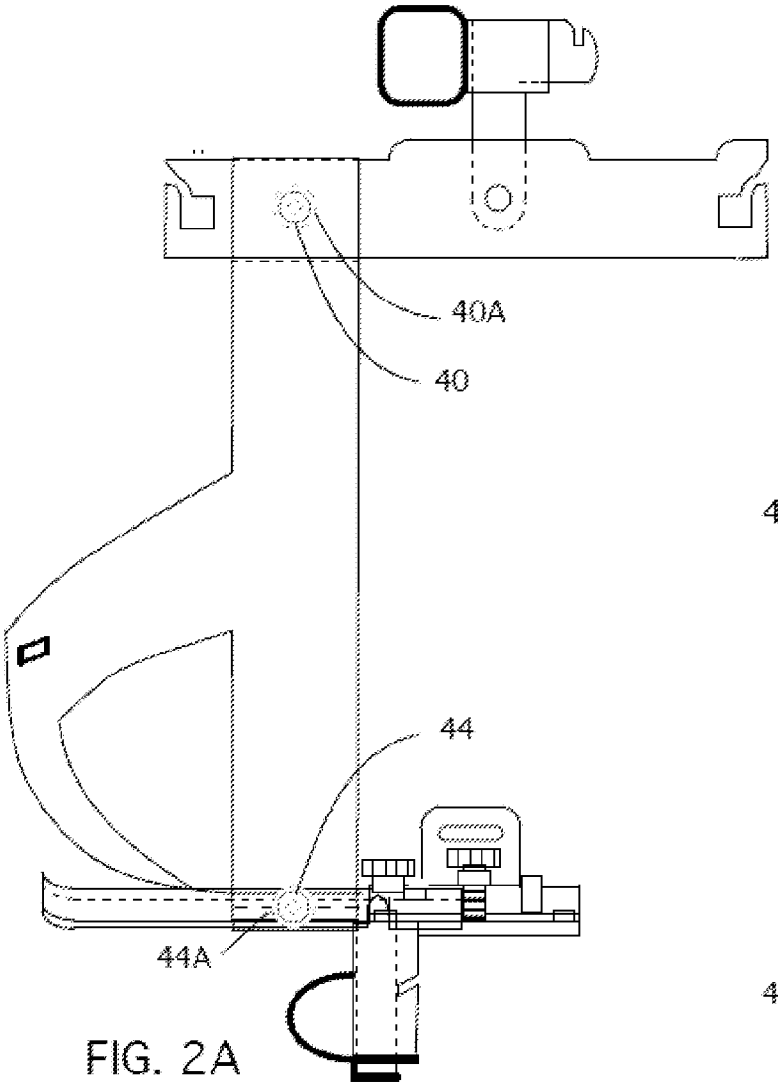
FIG. 2A is a block diagram illustrating a front view of a right section of the sling system configured in accordance with one embodiment.

A right side main frame 82 of FIG. 4B, a back side connector FIG. 3B, a right leg support FIG. 4A, and a front side connector FIG. 4C can be grouped using two Carriage bolts-Square neck 40, 44 of FIG. 2A, and their respective Miniature Clamping knobs 40A, 44A of FIG. 2A, and a clamping knob 112 to form the right section FIG. 2A of the sling system. All parts are configured to be assembled or disassembled without tools in accordance with one embodiment of this invention.

The left side main frame 42 of FIG. 2B and the left leg support 46 of FIG. 2B may be grouped together using a carriage bolt-square neck 48 of FIG. 2B with proper miniature clamping knob 48A of FIG. 2A to form the left section FIG. 2B of the sling system. These members may be disassembled upon demand. All members are configured to be assembled or disassembled without tools in accordance with one embodiment of this invention.

When the left section FIG. 2A and the right sections FIG. 2B of the sling system are connected together, it will support the area under the thigh close to the knee, the buttocks and continuing up the back to the area under the shoulder blades and it resembles a legless chair with an opening in the center. This opening at the center serves two purposes: 1) it facilitates the placement of the sling system sections under the disabled person in accordance with one embodiment and 2) the sling system may be used for toilet and bathing purposes in accordance with another embodiment of this invention.

All the constituent pieces that are subject to come into contact with the body of the disabled person have a hypoallergenic coating in accordance with one embodiment of this invention.

Referring to FIG. 7, the constituent portion of the right main frame 82 are a right-long frame 83 and a right-side support 93. The right long frame 83 is hemmed at both ends, a back hem 160 and a front hem 166. The front hem 166 has a special form 168 and will receive the right leg support 100 of FIG. 4A. The back hem will receive the right side of a back side connector plate 74 of FIG. 3B. The left side support 150, in addition to providing a side support for a disabled person, also prevents folding of left-long frame 43. In the right-side support 93 is a cutout 92 of FIG. 4B for the purpose of securing the right side hanging strap 34 of FIGS. 1 and 7 and the short segment of the safety strap 162 of FIG. 7. The right main frame 82 and its constituent portions 83 and 93 may be made of a thin flat alloy metal, a reinforced plastic, fiberglass, or some other resilient material having a thickness of about 1.5 mm and a width of at least 5 cm. A front view of the right main frame 82 is shown in FIG. 4B.

Figures 5A, 5B, 5C, 6:
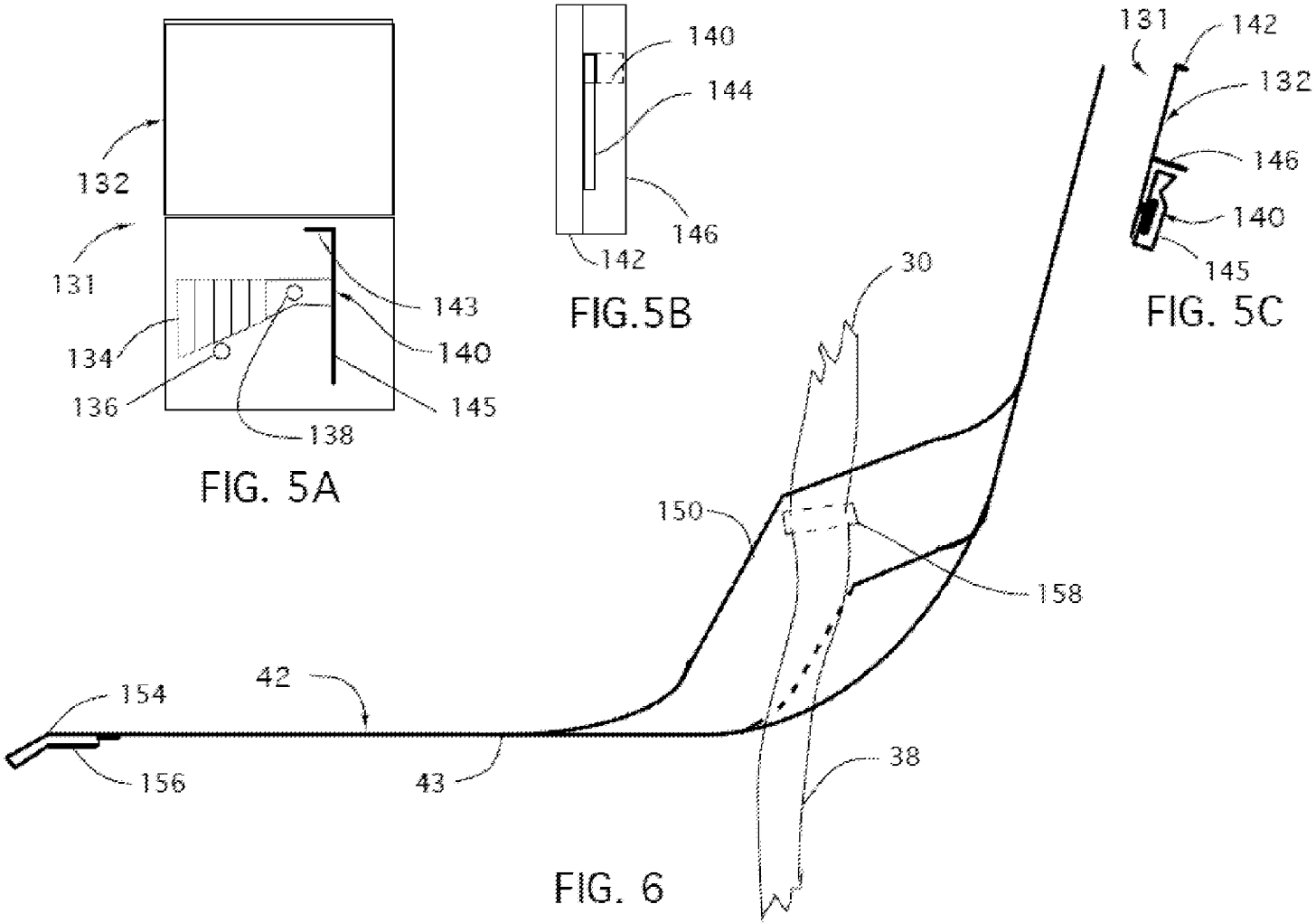
FIG. 5A is a block diagram illustrating a front view of FIG. 5C configured in accordance with one embodiment.
FIG. 5B is a block diagram illustrating a top view of FIG. 5C.
FIG. 5C is a block diagram illustrating side view of a back side connector plate of FIG. 3B receiver configured in accordance with one embodiment.
FIG. 6 is a block diagram illustrating a side view of a left side main frame configured in accordance with one embodiment.

Referring to FIG. 6, the constituent portions of the left main frame 42 are a left-long frame 43 and a left-side support 150. The left long frame 42 has a configured front hem 156 to receive a left leg support 46 of FIG. 2B. The back end of the left-long frame 43 is permanently attached to a back connector-receiving member 131 of FIGS. 5A, 5C. The left side support 150, in addition to providing a side support for a disabled person, also prevents folding of left-long frame 43. In the left-side support 150 is a cutout 158 for the purpose of securing the left side hanging strap 30 of FIGS. 1 and 6 and the long segment of the safety strap 38 of FIGS. 1 and 6. The left main frame 42 and its constituent portions 43 and 150 may be made of a thin flat alloy metal, a reinforced plastic, fiberglass, or some other resilient material having a thickness of about 1.5 mm and a width of at least 5 cm. A front view of the left main frame 42 is shown in FIG. 2B.

FIGS. 5A and 5B are a front and a top view of FIG. 5C respectively. Referring to FIG. 5C, the back connector receiver member 131 is permanently attached to the back end of the left main frame 42. It has a guiding member 132 and a latching member 140. The guiding member 132 has guiding elements 142, 146 and the latching member 140 has a hook end plate 143, a push plate 145 for the purpose of unlatching, a counter weight 134, a stopper 136 and a pivoting pin 138. FIG. 5B shows that the guiding element 146 has a cutout 144 that serves two purposes. First, it acts as a guide for a notch 64 of a grip member 63 of FIG. 3B to properly pass through and latch on the hook end 143 of the latching element 140. Second, it secures the grip element 52 of FIG. 3A, preventing the back side connector 74 of FIG. 3B from being disconnected from the receiving member 131 of FIG. 5C when it is in use.

Figure 3A:
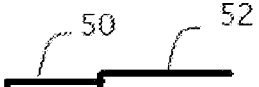
FIG. 3A is a block diagram illustrating a top view of a grip member 63 of FIG. 3B.
Figure 3C:
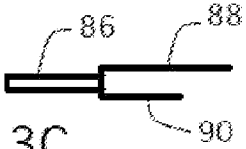
FIG. 3C is a block diagram illustrating a front view of a grip member of FIG. 4C.
Figure 3D:
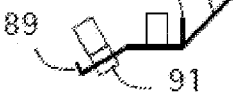
FIG. 3D is a block diagram illustrating a side view of a bracket of FIG. 4C in accordance with one embodiment.

The front view of the front side connecter is presented in FIG. 4C. The bracket 124 is made of alloy steel with a 2-3 mm thickness. It is about 10 centimeter long and has a width and a shape corresponding to the width and the shape of the leg supports 100 of FIG. 4A and 46 of FIG. 2B. This bracket 124 has a strap receiving element 113, three guiding pins 116, 118, 134, a guiding stud 132, a safety stud 126, a clamping knob 112, bar knob 114, and two walls 87, 89 of FIG. 3D. The height of the short wall 89 of FIG. 3D is equal to the thickness of the leg supports 100, 46 of FIGS. 2A, 2B respectively, and the height of the other wall 87 of FIG. 3D is around 12 mm. The function of this bracket 124 is to connect and align the leg supports 100, 46 of FIGS. 2A, 2B respectively. The pin 134, with a height of around 15 mm, passes through the right side of the bracket 124 and is secured in a way that the top portion of it is used as a guiding element 134 for the right leg support 100 of FIG. 2A, and the bottom portion is used as the pin 91 of FIG. 3D for pivoting front connector-locking system 130. After placing the right and the left leg supports in their proper place into the bracket 124 to unify them, the locking system 130 should be pivoted counter-clockwise over the leg supports, then the bar knob 114 is hand tightened for safety purposes. The locking system 130 has a handle 86 and two grip elements 88, 90 of FIG. 3C. The grip element 90 is also used as a pivoting element for the front side-connector locking system.

FIG. 4A shows the front view of a right leg support 100. It is made of a thick flat alloy, a reinforced plastic, fiberglass, or some other stiff material, which is about 5 mm thick, 5-6 cm wide and about 20 cm long. The right leg support has a smooth bend 108 in the center along the width. This bend corresponds with the shape of the hem 166 of FIG. 7 and the purpose is to provide a comfort zone under the thigh. It also has an upward curve 96 at the outside end to keep the leg from sliding off. The right leg support 100 has two 6 mm holes 98, 102, a 10 mm rounded end groove 104 and a 10 mm bore 108. After sliding the right leg support 100 through the hem 166 of FIG. 7, either one of the holes 98 or 102, in correspondence with the holes 60, 68 of FIG. 3B may be aligned with the hole 110 of FIG. 4B (depending on the size of the disabled person) and will be secured together by using a 6 mm carriage bolt-square neck 44 and its proper miniature clamping knob 44A of FIG. 2A. The round groove 104 and the bore 108 will accept the pin 134 and the stud 132 of FIG. 4C respectively upon installation.

FIG. 2B shows the front view of a left leg support 46 positioned in its proper place into the hem 154 of FIG. 6 using a 6 mm carriage bolt-square neck 48 and its proper miniature clamping knob 44A of FIG. 2B. The shape of the left leg support 46 of one such embodiment is a mirror image of the right leg support 100 with the exception of having only one 6 mm hole 47 in correspondence with the guiding elements 66, 68 of FIG. 3B. The round end groove 45 and the bore 41 will accept the pins 118, 116 of FIG. 4C respectively, upon installation. The back side connector plate 74 is made of a thick flat alloy, a reinforced plastic, fiberglass, or some other stiff material which is about 5 mm thick, 5-6 cm wide, and an appropriate length.

FIG. 3B presents the front view of the back side connector. It consists of a back side connector plate 74 and a locking system 61. The back side connector plate has two cutouts 70 and 78. These cutouts have their respective lead-in notches 72 and 80 at both ends to guide the back strap 24 of FIG. 1 to pass through and seat it into position, or to remove the back strap 24 from the position in accordance with one embodiment of this invention. The plate 74 has two 6 mm holes, 60 and 78, two guiding elements 66 and 68, and around its center has a pivoting pin 76. The constituent elements of the locking system 61 are: a handle 50, a pivoting arm 62, and grip elements 52, 54 of FIG. 3A. FIG. 3A is the top view of grip member 63 of FIG. 3B. Notice that the grip element 52 of FIG. 3A is longer than the other grip element and at its end has a notch 64 of FIG. 3B. The grip member is made of bend resistant alloy steel.

To install the back side connector FIG. 3B on the right main frame 82 of FIG. 4B the back side connector plate 74 is simply slid into the hem 160 of FIG. 7, the hole 56 of FIG. 4B is aligned with either holes 60 or 78 of FIG. 3B (in correspondence with the usage of holes 98 or 102 of FIG. 4A for installing the right leg support), then a 6 mm carriage bolt-square neck 40 of FIG. 2A is inserted into the holes and they are secured using miniature clamping knob 40A of FIG. 2A.

Referring to FIG. 1, a right hanging strap 34 is coupled to the right-side support 93 through the cutout 92 of FIGS. 4B, and 7 and from the other end, after passing through a configured ring 26, is threaded through a buckle 10 having a hooked end shape 10. It also shows the left hanging strap 30 is coupled to the left-side support 150 of FIG. 6 through the cutout 158 of FIG. 6, and from the other end, after passing through a configured ring 26A, is threaded through a buckle 16 having a hooked end shape 16A.

FIG. 1 also shows a front hanging strap 15. The bottom segment 36 of front hanging strap 15 is coupled to the strap receiving element 113 of FIG. 4C and, from the other end, is threaded through a buckle 32. Two top segments 20, 22 of front hanging strap 15 are, from one end, secured to the same buckle 32 and, from the other ends, secured to proper configured hooks 14, 12 respectively. The back support strap 24, from one end, snaps on the configured ring 26 of the right hanging strap 34 using an eye hook 18, then through the configured lead-in notches 70, 80 sit in the cutouts 72, 78 and, from the other end, snaps on the configured ring 26A of the right hanging strap 30 using an eye hook 18A. The long segment of the safety strap 38 is coupled to the lowest end of the left hanging strap 30 and, from the other end, is free. When the sling system is properly positioned under the person and is lifted from the wheelchair, the long segment of the safety belt 38 should be passed from under the person, threaded through the configured buckle 164 of FIG. 7, then pulled to tighten before removing the wheelchair All straps are made of stretch resistant flexible material, but that are soft upon touch, such as heavy duty polyester.

For further clarification, if needed, FIGS. 8 through 13 depict the features and the function of the sections, members, and parts described therein.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure. For example, straps can be logistic, ratchet, or cam strap, etc., the holes of the back connector plate can have other shapes, such as circular, oval, triangular, etc., the locking system may be replaced by a quick release clamp, etc., and the bar knob may be replaced by a double cam clamp, etc. Thus the scope of the embodiments should be determined by the appended claims and their legal equivalents.

Each of the various embodiments described above may be combined with other described embodiments in order to provide multiple features. Furthermore, while the foregoing describes a number of separate embodiments of the apparatus and method of the present invention, what has been described herein is merely illustrative of the application of the principles of the present invention. Accordingly, this description is meant to be taken only by way of example, and not to otherwise limit the scope of this invention.

What is claimed is:

1. A rigid, two-piece sling system to facilitate the lifting of a disabled person that is in a sitting position for a variety of purposes, said system comprising:

a first side section, wherein said first side section supports a first side of said disabled person from under a thigh close to a knee, a buttock, the first side and continuing up a back to an area under the shoulder blades, said first side section further comprising:

a first side hanging strap;

a first side safety strap;

a first side main frame, said first side main frame being configured to removably and adjustably be coupled to a first side leg support at a proximal front end, to removably and adjustably be coupled to a back connector at a proximal back end, said first side main frame further configured to be coupled to said first side hanging strap and a first side segment of said safety strap at a proximal mid-portion of said side;

a front hanging strap; and a back support strap; and a second side section, wherein said second side section supports a second side of said disabled person from under the thigh, close to the knee, the buttock, the second side and continuing up the back to the area under the shoulder blades, said second side section further comprising:

a second side safety strap;

a second side hanging strap; and a second side main frame, said second side main frame being configured to be removably coupled to a second side leg support at a proximal front end and configured for said back connector to be releasably disposed at a proximal back end which includes a latching system, and wherein said second side main frame is configured to be coupled to said second side hanging strap at a proximal mid-portion of the second side and wherein said first side main frame and said second side main frame are slid under said disabled person and configured to be coupled forming a comfortable legless chair to be lifted.

2. The system according to claim 1 wherein said first side hanging strap is configured to be coupled to said first side main frame at a proximal bottom end and to be coupled to a first side buckle at a proximal top end wherein said first side buckle is configured to be removably received by a lifter, wherein said first side hanging strap is configured at a proximal middle to releasably accept said back support strap.

3. The system according to claim 1 wherein said second side hanging strap is configured to be coupled to said second side main frame at a proximal bottom end and to be coupled to a second side buckle at a proximal top end wherein said second side buckle is configured to be received by the lifter, wherein said second side hanging strap is configured at a proximal middle to releasably accept said back support strap.

4. The system according to claim 1 wherein said back side connector is configured to be at least at one position coupled to said first side main frame at a proximal first side end, and pivotally connected to a locking system at a proximal center configured to grip said second side end when disposed in said proximal end of the second side main frame, said back connector being configured to removably accept said back support strap.

5. The system according claim 1 wherein said back support strap is received by said back connector, wherein said back support strap at one end is configured to be releasably coupled to said first side hanging strap and from another end is configured to be releasably coupled to said second side hanging strap.

6. The system according to claim 1 wherein said front hanging strap further comprises: a bottom segment and a top segment, said bottom segment extending from a proximal front of said two-piece sling system at a front connector coupled to a front-mid buckle included in approximately a center of said front hanging strap.

7. The system according to claim 6 wherein a top segment of said front hanging strap comprises at least a top strap, said top strap at a proximal bottom end configured to be coupled to said front-mid buckle located at a proximal center of said front hanging strap and at a top proximal end to be coupled to a top strap buckle, said top strap buckle to be received by the lifter.

8. The system according to claim 6 wherein said front side connector is configured to be removably coupled to said first side leg support and further includes a front locking system configured to pivotally grip at least one of the said leg supports when disposed into said front side connector, said front side connector further configured to be coupled to said front hanging strap.

9. The system according to claim 1 wherein said first side safety strap at a proximal top end is configured to be coupled to said first side main frame and at a proximal bottom end to be coupled to a buckle configured to removably receive said second side safety strap.

10. The system according to claim 1 wherein said second side safety strap at a proximal top end is configured to be coupled to said second side main frame and at a proximal bottom end to be removably received by said buckle of the first side safety strap, and wherein said first side safety strap and said second side safety strap are removably connectable to safely secure the disabled person when lifted and before transferring takes place.

11. The system according to claim 1 wherein said two-piece sling system components that are in contact with the disabled person are coated by a soft touch hypoallergenic material.

12. The system according to claim 1 wherein said back connector and said first side leg support are correspondingly adjustable, and wherein said two-piece sling system may be used by different size users.

13. The system according to claim 1 wherein said first side hanging strap, said second side hanging strap, said first side safety strap, said second side safety strap, and said back support strap are adjustable.

* * * * *